US006045326A

United States Patent [19]

Lecat

[11] Patent Number: 6,045,326

[45] **Date of Patent: *Apr. 4, 2000**

[54] PUMP HAVING COMBINED CENTRIFUGAL AND AXIAL FLOW

[76] Inventor: Pierre Lecat, 46 Boulevard Longchamp, Marseilles, France, 13001

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,229

[22] PCT Filed: Sep. 14, 1995

[86] PCT No.: PCT/FR95/01184

§ 371 Date: Mar. 18, 1997

§ 102(e) Date: Mar. 18, 1997

[87] PCT Pub. No.: WO96/09476

PCT Pub. Date: Mar. 28, 1996

[30] Foreign Application Priority Data

Sep. 19, 1994 [FR] France ..... 94 11466

[51] Int. Cl.[7] ..... F04D 29/44

[52] U.S. Cl. ..... 415/206; 415/208.1

[58] Field of Search ..... 415/206, 208.1

[56] References Cited

U.S. PATENT DOCUMENTS

| | | | |
|---|---|---|---|
| 2,524,269 | 10/1950 | Patterson | 103/5 |
| 3,723,028 | 3/1973 | Bottoms et al. | 417/356 |
| 5,451,139 | 9/1995 | Tadiello | 415/208.1 |
| 5,597,287 | 1/1997 | Helmick | 415/206 |

FOREIGN PATENT DOCUMENTS

| | | |
|---|---|---|
| 1528010 | 6/1968 | France . |
| 2608228 | 6/1988 | France . |

*Primary Examiner*—John Kwon

*Attorney, Agent, or Firm*—Greenblum & Bernstein, P.L.C.

[57] ABSTRACT

A centrifugal/axial flow pump includes both a spiral centrifugal impeller, and a tube leading to the centrifugal impeller with an internal spiral having a free diameter in the axial center. The internal spiral induces preliminary axial flow, providing a pre-whirl of a liquid before it reaches the centrifugal impeller at its inlet, and forces axial flow and "stuffs" or "crams" liquid into the inlet, increasing liquid pressure at the centrifugal impeller inlet. The centrifugal impeller and the axial flow spiral both induce flow. The tube may include an extension forming an electric motor shaft to provide a unitary motor pump in which the liquid to be pumped cools the tube and the motor rotor. The tube extends from the centrifugal impeller eye to the pump flange, where it is sealed, so as to improve pump tightness over the conventional centrifugal pump.

9 Claims, 2 Drawing Sheets

PUMP HAVING COMBINED CENTRIFUGAL AND AXIAL FLOW

BACKGROUND OF THE INVENTION

1. Field of the Invention

The present invention relates to new axial flow pumps improving the qualities of the currently available conventional pumps.

2. Discussion of Background Information

Centrifugal pumps include a motor driven impeller and a spiral stationary stator to provide a pressurized fluid output. FIGS. 1*a* and 1*b* show a diagram of a conventional centrifugal pump, including an Impeller R, a Spiral V, an Outlet S, and Inlet E, and an Impeller eye O.

In the conventional centrifugal pump, at least two major difficulties are encountered as follows:

1) losses due to water or liquid leaks between the water inlet and outlet, i.e., the return of the water to the impeller eye, with a decrease in suction; and
2) the cavitation effects in the impeller. Upon reaching the impeller eye, the very fast whirl of the liquid "breaks the threads", creates cavitation, and wears out the buckets of the impeller, with a resultant loss in efficiency.

SUMMARY OF THE INVENTION

The device according to the invention is constituted by a tube attached on the impeller, and extends from the impeller eye up to the pump flange. By this structure, sealing is easier to obtain and maintain (o-rings for example).

The tube is provided with an internal spiral forming an Archimedes' tube with a hollow center (or equivalent vanes). The internal spiral is a known surface: helical with a constant-angle director cone. Thus, there is a mechanical pre-whirl of the liquid in the tube which rotates at high speed, before it reaches the impeller eye. This translates into a "saturation" of the impeller, a reduction in the cavitation and the resultant wear of the impeller.

Further, if the tube is extended, it can serve as an electric motor shaft, with the rotor attached on the tube, forming a unitary motor pump. If the pump is characterized by the extension of the tube to serve as the electric motor shaft, the shaft is attached on the motor rotor.

From this arrangement, it can be seen that the liquid directly cools the rotor, and therefore the electric motor. The cooling fan, blades, etc. can be suppressed.

DETAILED DESCRIPTION OF THE INVENTION

As shown in FIGS. 2*a*–2*c* and 3, the device according to the invention is constituted by a tube Tu attached on the impeller R, and extends from the impeller eye up to the pump flange. By this structure, sealing is easier to obtain and maintain (O-rings J for example).

Figure 1B:
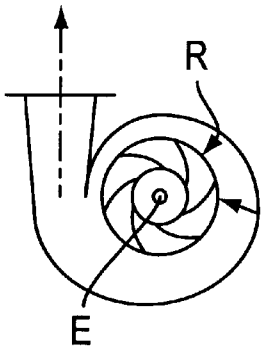
FIG. 1B (PRIOR ART)
FIG. 1*b* is an inlet end view of the pump of FIG. 1*a;*
Figure 2A:
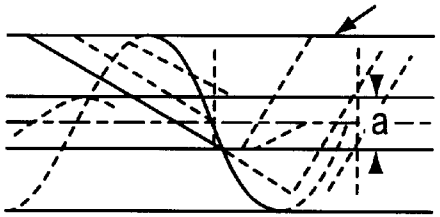
FIG. 2*a* is a side sectional view of the spiral tube of the present invention.
Figure 2C:
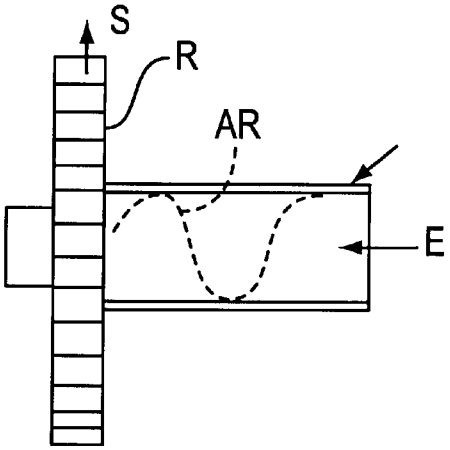
FIG. 2*c* is an enlarged sectional view of components of FIG. 2*b*; and, FIG. 3 is a side sectional view of a unitary motor pump.
Figure 1A:
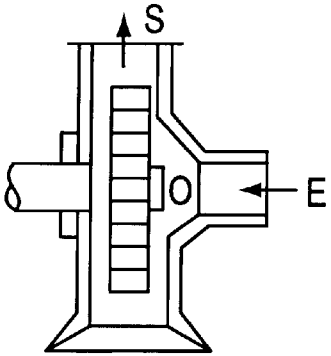
FIG. 1A (PRIOR ART)
FIG. 1*a* is a side sectional view of a conventional centrifugal pump.
Figure 2B:
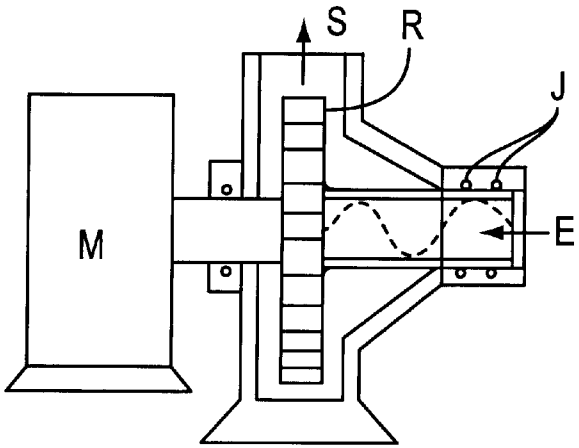
FIG. 2*b* is a side sectional view of the pump of the present invention including the spiral tube of FIG. 2*a;*

The tube is provided with an internal spiral AR forming an Archimedes' tube with a hollow center "a" (or equivalent vanes). FIG. 2*a* shows detail of the Archimedes' spiral with hollow center, where "a" is a free diameter. FIG. 2*b* shows an impeller R mounted with the new tube (and seals J). FIG. 2*c* shows the same impeller R, tubes Tu, and internal spiral AR, (where "Pr" in FIG. 3 indicates water progression in a tube Tu of the same configuration) and showing seals J, the motor M, the Motor flange Fl, and the tube Tu. The internal spiral AR is a known surface: helical with a constant-angle director cone. It is well known that an Archimedes' or Archimedean spiral is defined as a plane curve having an equation in polar coordinates (r, θ) of $r^m=a^m\theta$, where a and m are integers. Thus, there is a mechanical pre-whirl of the liquid PR in the tube Tu which rotates at high speed, before the liquid reaches the impeller R eye. This translates into a "saturation" of the impeller R or forced flow ("gavage" in French—"stuffing" or "cramming") to the impeller R. The impeller R thereby receives forced flow at increased pressure ("Gavage"), while whirling, and reducing cavitation and wear of the impeller R. The size of the impeller R, of the tube Tu and of the spiral AR are determined according to the characteristics required in the pump. It is well known in the art of turbomachinery such characteristics include system properties, inlet properties, fluid properties, and discharge properties, and methods for estimating the likelihood of cavitation in a system and for measuring empirical cavitation are similarly well known and easily carried out.

Figure 3:
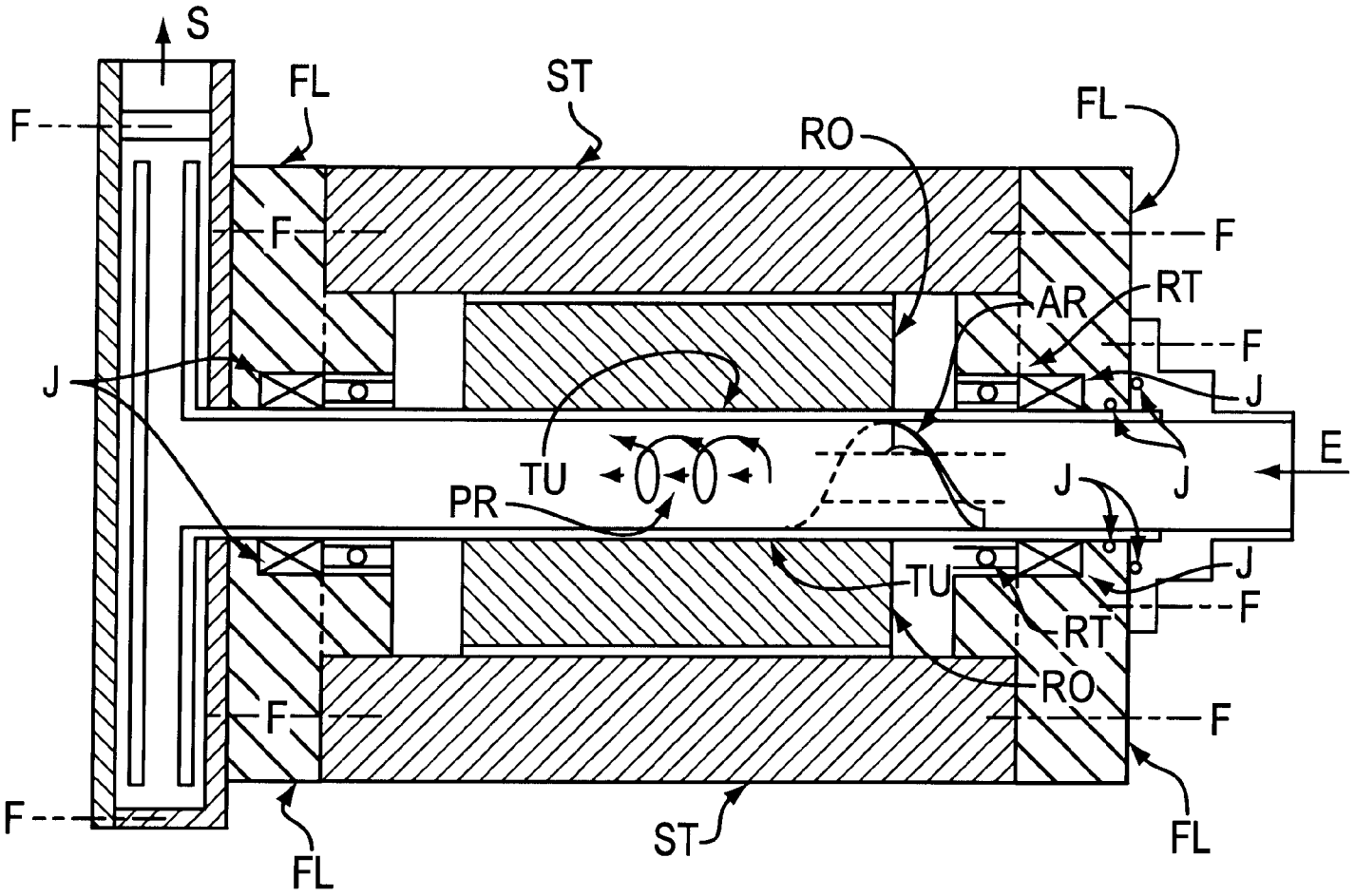

Further, if the tube Tu is extended, the tube Tu can serve as an electric motor shaft, with the rotor attached on the tube, forming a unitary motor pump. FIG. 3 shows an impeller R with the tube Tu and spiral AR forming the motor shaft, e.g., a unitary motor pump. FIG. 3 shows the bearings Rt, seals J, mountings F, stator ST, and rotor Ro. From this arrangement, it can be seen that the liquid directly cools the rotor Ro, and therefore the electric motor. The cooling fan, blades, etc. can be suppressed.

As shown in FIGS. 2*a*–2*c* and 3, the Archimedes' spiral is inclined with respect to a plane of the centrifugal pumping vanes in the impeller R by an angle sufficient to complete at least one fill turn within a length of the tube portion Tu, and, as shown, completes at least 1 full rotation about the internal diameter of the tube Tu along its length.

What is claimed is:

1. A pump having combined centrifugal and anal flow for pumping a liquid, comprising:

a pump housing provided with at least one flange portion;

a rotatable centrifugal impeller having spiral vanes for centrifugal pumping and an eye region at an impeller inlet of the rotatable centrifugal impeller, an electric motor including a rotor; and a cylindrical axial flow tube attached to the rotatable centrifugal impeller at the impeller inlet said axial flow tube having an internal Archimedes' spiral vane having a free diameter in a center thereof the internal spiral provided with a helical surface having a constant angle director cone;

wherein the cylindrical axial flow tube extends the eye region of the centrifugal impeller to the flange portion of the pump housing, and the internal Archimedes' spiral vane imparting a pre-whirl to the liquid and increasing pressure at the eye region to reduce cavitation by forcing flow of the liquid to the pump impeller, said cylindrical axial flow tube and said rotatable centrifugal impeller together pumping the liquid, wherein said internal Archimnedes' spiral vane completes at least 1 full rotation about an internal diameter of said axial flow tube along the length of said axial flow tube, the cylindrical axial flow tube further being connected to the motor rotor as a shaft for the electric motor and the pumped liquid directly cooling the electric motor.

2. A pump having combined centrifugal and axial flow for liquids, said pump comprising:

a rotatable disk-shaped impeller having spiral vanes for centrifugal pumping and an impeller inlet;

an elongated tube attached to the impeller at the impeller inlet, a spiral vane for anal-flow pumping into said impeller inlet, said spiral vane formed substantially as an internal Archimedes' spiral vane having a helical surface with a constant-angle director cone for providing mechanical pre-whirl of the liquid and for increasing pressure at the eye region to reduce cavitation by forcing liquid flow to the impeller inlet, said internal Archimedes' spiral vane having a free diameter along the axial center of the elongated tube, wherein said internal Archimedes' spiral vane completes at least 1 full rotation about an internal diameter of said elongated tube along the length of said elongated tube.

3. The pump according to claim 2, wherein said helical surface with a constant-angle director cone is formed as substantially a plane curve having an equation in polar coordinates (r, θ) of $r^m=a^m\theta$ where a and m are integers, with a free diameter through the axial center.

4. The pump according to claim 2, further comprising:

a pump housing for encasing the impeller;

a flange through which the elongated tube extends; and a motor attached to the elongated tube for rotating the elongated tube.

5. The pump according to claim 4, wherein:

the motor is an electric motor and the elongated tube is constructed to constitute the motor shaft of the electric motor, the electric motor having a rotor to which the shaft is attached, whereby the liquid directly cools the electric motor.

6. A pump having combined centrifugal and axial flow for liquids, said pump comprising:

a pump housing;

a rotor having a disk-shaped portion and a tube portion within said pump housing, said disk-shaped portion and said tube portion being joined in a substantially T-shaped cross-section, and said disk-shaped portion and said tube portion rotating together as a unit;

centrifugal pumping vanes formed in a spiral in said disk-shaped portion to form a centrifugal impeller; and at least one axial spiral vane along an internal diameter of said tube portion, and having a free diameter through the axial center of the tube portion, said axial spiral vane pre-whirling said liquid and increasing pressure and reducing cavitation by inducing axial flow to force pressurized liquid flow to said disk portion where said centrifugal pumping vanes induce centrifugal flow and again force liquid flow, said centrifugal pumping vanes and said axial spiral vanes thereby pumping said liquid in combination while reducing said cavitation in said fluid where said centrifugal pumping vanes receive liquid flow from said tube portion;

said spiral vane being inclined with respect to a plane of said centrifugal pumping vanes by an angle of an amount such that an imaginary line taken along said spiral vane completes at least one full turn about an inner circumference of said tube portion within a length of said tube portion.

7. The pump according to claim 6, said at least one axial spiral vane being formed substantially as an Archimedes' spiral along an internal diameter of said tube portion, said Archimedes' spiral vane having a free diameter in the axial center of the tube portion.

8. The pump according to claim 7, wherein said Archimedes' spiral vane is formed as a helical surface with a constant-angle director cone substantially reducing cavitation at the impeller inlet.

9. The pump according to claim 7, wherein said helical surface of said Archimedes' spiral vane completes at least one full turn within a length of said tube portion.

* * * * *